US008197649B2

(12) United States Patent
Saiki et al.

(10) Patent No.: US 8,197,649 B2
(45) Date of Patent: Jun. 12, 2012

(54) ION EXCHANGE MEMBRANE ELECTROLYTIC CELL

(75) Inventors: Koji Saiki, Takasago (JP); Kiyohito Asaumi, Tamano (JP); Mitsuharu Hamamori, Nagoya (JP); Tsugiyoshi Osakabe, Nagoya (JP)

(73) Assignees: Chlorine Engineers Corp., Ltd. (JP); Kaneka Corporation (JP); Toagosei Co., Ltd. (JP)

( * ) Notice: Subject to any disclaimer, the term of this patent is extended or adjusted under 35 U.S.C. 154(b) by 1164 days.

(21) Appl. No.: 11/914,668

(22) PCT Filed: May 17, 2006

(86) PCT No.: PCT/JP2006/309859

§ 371 (c)(1),
(2), (4) Date: Nov. 19, 2007

(87) PCT Pub. No.: WO2006/123716

PCT Pub. Date: Nov. 23, 2006

(65) Prior Publication Data

US 2009/0071820 A1 Mar. 19, 2009

(30) Foreign Application Priority Data

May 17, 2005 (JP) ..... 2005-144354

(51) Int. Cl.

| | |
|---|---|
| ***C25B 9/06*** | (2006.01) |
| ***C25B 9/08*** | (2006.01) |
| ***C25B 1/46*** | (2006.01) |
| ***C25B 11/03*** | (2006.01) |

(52) U.S. Cl. ..... 204/252; 204/266; 205/516; 205/526; 205/531; 205/537

(58) Field of Classification Search ..... None
See application file for complete search history.

(56) References Cited

U.S. PATENT DOCUMENTS 3,527,690 A * 9/1970 Bachelard et al. ..... 204/284
(Continued)

FOREIGN PATENT DOCUMENTS

JP 2946328 9/1999
(Continued)

OTHER PUBLICATIONS

European Search Report Published Mar. 14, 2012 in corresponding European Patent Application No. EP 11 19 2778.

*Primary Examiner* — Harry D Wilkins, III
(74) *Attorney, Agent, or Firm* — Ostrolenk Faber LLP

(57) ABSTRACT

[Problems] The liquid pressure of an anode chamber in a two-chamber ion exchange membrane electrolytic cell using a gas diffusion electrode are different among one another depending on depths so that the liquid pressures are applied on an anode or an ion exchange membrane, thereby introducing damage or deformation of the elements.

[Means for Solving] A cushion material 10 is accommodated between a cathode gas chamber back plate 9 and a gas diffusion electrode 7 of an ion exchange membrane electrolytic cell 1 such that a repulsive force of the cushion material at the bottom part of the cathode gas chamber is larger than that at the top part. The excessive pressure applied to an ion exchange membrane is suppressed to prevent the generation of scratches or the like by decreasing the repulsive force of the cushion material toward the top in accordance with a differential pressure between an anode chamber pressure and a cathode gas chamber pressure.

13 Claims, 2 Drawing Sheets

U.S. PATENT DOCUMENTS 4,340,452 A * 7/1982 deNora ..... 205/525
4,389,289 A * 6/1983 deNora ..... 205/511
4,468,311 A * 8/1984 de Nora et al. ..... 204/252
4,657,651 A * 4/1987 Wainerdi ..... 204/265
4,792,388 A 12/1988 de Nora ..... 204/98
5,052,064 A * 10/1991 Hagemeister et al. ..... 5/246
6,165,332 A * 12/2000 Gestermann et al. ..... 204/258
2002/0195756 A1 * 12/2002 Wells et al. ..... 267/93

FOREIGN PATENT DOCUMENTS

JP 2000-273560 10/2000
JP 2004-300547 10/2004
JP 2004/300554 A * 10/2004

* cited by examiner

ION EXCHANGE MEMBRANE ELECTROLYTIC CELL

TECHNICAL FIELD

The present invention relates to an ion exchange membrane electrolytic cell, and in particular to the two-chamber ion exchange membrane electrolytic cell using a gas diffusion electrode.

BACKGROUND OF INVENTION

Currently, brine is electrolyzed to produce hydroxide and chlorine by employing a so-called ion exchange membrane method (refer to the below formula (1)). While its theoretical decomposition voltage is about 2.25 V, the operation is practically conducted at about 3 V due to the ohmic potential drop and the overpotential of an electrode existing in the system.

$$2NaCl+2H_2O \rightarrow Cl_2+2NaOH+H_2 \quad (1)$$

The chloroalkali industry consumes a great deal of energy. Accordingly, for significant energy saving, a method is investigated which includes a reaction in which a gas diffusion electrode is used as a cathode to reduce oxygen (refer to the below equation (2), and the reaction will be hereinafter referred to as "oxygen cathode method").

$$2NaCl+\tfrac{1}{2}O_2+H_2O \rightarrow Cl_2+2NaOH \quad (2)$$

This method lowers the theoretical decomposition voltage to 1.14V. Due to the ohmic loss and the electrode overvoltage, the practical operation is conducted at about 2 V. Since no hydrogen is generated, the energy saving of 30% or more can be expected.

As one of the oxygen cathode methods, a method is proposed in Japanese patent laid open gazette No. 11-124698 in which the gas diffusion electrode is in close contact with the ion exchange membrane to practically eliminate the cathode liquid chamber or in which the cathode chamber is configured as a cathode gas chamber. This method is referred to as a two-chamber method because the electrolytic cell consists of the anode chamber and the cathode gas chamber. This method has an advantage that the electrolysis voltage can be reduced to minimum because the anode, the ion exchange membrane and the cathode are in contact with one another to reduce the interelectrode resistance to the minimum.

In order to hold the electrolyte (catholyte) uniformly on the entire surface by closely contacting the gas diffusion electrode on the ion exchange membrane in this method, an elastic material (cushion material) is elastically accommodated in the cathode chamber so as to press the gas diffusion electrode to the anode through the ion exchange membrane by using the repulsive force generated therein. In order to hold the electrolyte more securely, a carbon cloth having good fluid retaining ability may be sandwiched between the ion exchange membrane and the gas diffusion electrode (Japanese patent gazette No. 3553775). Use of a mat or a coil prepared by stacking demister meshes as the cushion material is under consideration. The mat is obtained by stacking a plurality of metal wires which are subjected to stockinette stitch and a wave making process. The depth of the waves is about 2 to 10 mm. The wave making process generates a repulsive force. On the other hand, the coil is obtained by roller finish. The coil axis is disposed parallel to the back plate of the cathode gas chamber. The repulsive force is generated when the coil ring is compressed along its diameter. The coil diameter is 2 to 10 mm.

High concentration oxygen, water vapor and caustic soda mist which makes a severe corrosion environment exist in the cathode gas chamber of which a temperature reaches around 90° C. so that the cushion material is required to be excellently corrosion-resistive. The cushion material also has a role of discharging current from the gas diffusion electrode to the back plate of the cathode gas chamber. The cushion material is made of nickel or high nickel alloy which satisfies the above requirements.

Oxygen is supplied from the rear of the gas diffusion electrode to the inside thereof in the cathode gas chamber. Accordingly, the thinner cathode gas chamber is advantageous. On the other hand, in the electrolytic cell having several square meters of the active area, the thicknesses of the cathode gas chamber spread in several millimeters depending on their positions, and the compression displacements of the cushion material differ from one another in several millimeters depending on their positions resulting in the generation of the difference of the repulsive forces exerting on the gas diffusion electrode. In order to control the repulsive force in the required and accepted range, the average thickness of the cathode gas chamber is established from 4 to 10 mm.

The repulsive force is generally recognized as follows.

A liquid pressure of brine is exerted in the anode chamber and a gas pressure is exerted in the cathode gas chamber which is separated from the anode chamber by an ion exchange membrane. The typical depth of the brine in the anode chamber is about one meter, and the pressure at the deepest part is about 11 kPa. On the other hand, the cathode gas chamber pressure at the uppermost part of the inlet is only about 1 to 2 kPa. The cushion material is required to supply the repulsive force sufficient to compensate for the above pressure difference. An insufficient repulsive force separates the anode from the ion exchange membrane and the entire gas diffusion electrode, thereby elevating the voltage. The repulsive force is generally established between about 12 to 20 kPa.

DISCLOSURE OF INVENTION

Problems to be Solved by Invention

As described, the repulsive force of the cushion material is established in accordance with the pressure difference between the anode chamber pressure at the deepest part (lowest part) of the anolyte in the electrolytic cell, and the cathode gas chamber pressure. In this case, the pressures at the bottom parts of both chambers sandwiching the ion exchange membrane balance so that the ion exchange membrane is in close contact with the anode. However, if the pressure is established based on the deepest part (lowest part), useless and excessive pressure is exerted at the top part. The excessive pressure is supported by the anode mesh so that the ion exchange membrane sandwiched between the anode mesh and the gas diffusion electrode receives the pressure at a point or a line. Accordingly, the ion exchange membrane is liable to be damaged. Further, the amount of the material is excessive.

An object of the present invention is to provide an ion exchange membrane electrolytic cell using a gas diffusion electrode which solves the above inconvenient problems.

Means for Overcoming Problems

The present invention is an ion exchange membrane electrolytic cell comprising an anode chamber accommodating an anode and a cathode gas chamber accommodating a gas diffusion electrode which are separated by an ion exchange membrane characterized in that a metallic cushion is accommodated under compression between a back plate of the cathode gas chamber and the gas diffusion electrode such that a repulsive force of the metallic cushion at a bottom part of the cathode gas chamber is larger than that at a top part of the cathode gas chamber. It is desirable in this electrolytic cell that the repulsive forces at the respective points along the longitudinal direction of the metallic cushion are larger than the differential pressures between the anode chamber pressures and the cathode gas chamber pressures, and the excessive pressures (=repulsive forces−anode chamber pressures+cathode gas chamber pressures) during the operation of the electrolytic cell are not more than 10 kPa. The metallic cushion is preferably a coil or a wavy mat. A metal wire may be made of Ni or high Ni alloy.

The present invention will be described in detail.

In the present invention, the pressures applied to the ion exchange membrane and the anode are made minimum by generating the repulsive force which equals to or is larger than the differential pressures different from one another depending on the depth of the electrolytic cell The differential pressure gradually increases depending on the depth of the electrolytic cell so that it is desirable that the repulsive force gradually increases with the increase of the differential pressure. However, in reality, the gradual increase of the repulsive force with the increase of the differential pressure can be hardly attained or is practically impossible. Accordingly, the present invention is configured such that at least the repulsive force at the top part of the cathode gas chamber of the electrolytic cell is smaller than that at the bottom part of the cathode gas chamber. The repulsive forces may be increased in the order of "top part of the cathode gas chamber"—"middle part of the cathode gas chamber"—"bottom part of the cathode gas chamber".

In the present invention, a metallic cushion is accommodated under compression in the cathode gas chamber of a two-chamber ion exchange membrane electrolytic cell in order to generate the repulsive force. The filter-press type electrolytic cell is desirably used and the cushion material is accommodated in the cathode gas chamber and compressed by tightening the electrolytic cell by means of a tie-rod, thereby generating the repulsive force. This repulsive force presses the gas diffusion electrode onto the ion exchange membrane, and desirably presses without any gap.

The metallic cushion applies the repulsive force to the gas diffusion electrode directly or through another element such as a gas diffusion electrode support. Desirably, the repulsive force is almost uniformly applied on the entire surface of the gas diffusion electrode. However, the repulsive force may be applied on only a part of the gas diffusion electrode, that is, on the right and left edges of the gas diffusion electrode along the longitudinal direction, or on the central part in addition to the right and left edges along the longitudinal direction. At any rate, equalization of the pressures (excessive pressures) applied on the ion exchange membrane and the anode can be attained by making the repulsive force generated in the top part of the cathode gas chamber smaller than the repulsive force generated in the bottom part.

The cushion material is made of metal for generating electro-conductivity and is required to have resistances against high-temperature and high-concentration oxygen atmosphere and alkaline highly corrosive environment. The metallic cushion is selected from materials having the above resistances, and use of Ni or high Ni alloy is preferable. The high Ni alloy refers to alloy in which the Ni content is 20% in weight or more and less than 100% in weight, and includes inconel, hastelloy, monel and SUS310. The metallic cushion is ordinarily plated with silver for maintaining the higher electro-conductivity. Pure silver can be used for the material of the metallic cushion. The pure silver is excellent in the electro-conductivity and the resistances, and is inferior in the reactivity and the cost.

Two kinds of the cushion materials can be used in the present invention. One is a mat, and the other is a coil. The mat can be obtained by machining meshes for demister to be in shape of wave (crimp). The meshes for demister are prepared by stitching metal wires in the shape of stockinette. The metal wires may have a diameter of about 0.02 to 5 mm. A bundle of several fine wires may also be used. The depth of the wire is about 4 to 10 mm. A resilience is generated in a direction perpendicular to the mat, and the repulsive force is generated in the same direction. The thicker wire is more rigid, and the thinner wire is softer. The increase of the number of wires to be bundled increases the rigidity. The increase of the number of sheets also increases the rigidity.

The mat "A" which is made by machining the meshes for demister in the shape of a wave is exemplified in FIG. 1. Three sheets of the mats are stacked in a part corresponding to the bottom part of the cathode gas chamber, two sheets of the mats are stacked in a part corresponding to the middle part of the cathode gas chamber, and one sheet of the mat exist in a part corresponding to the top part of the cathode gas chamber. When these mats are accommodated in the cathode gas chamber, the repulsive forces are generated in the following ascending order, that is, "top part of cathode gas chamber"<"middle part of cathode gas chamber,"<"bottom part of cathode gas chamber", thereby absorbing the differential pressures generated in the following ascending order, that is, "top part of cathode gas chamber"<"middle part of cathode gas chamber,"<"bottom part of cathode gas chamber". Accordingly, the excessive pressures applied on the ion exchange membrane and the anode are almost equalized.

The coil can be obtained by rolling metal thin wires.

The coil has the resilience along the diameter direction, and the resiliently accommodated coil generates the repulsive force along this direction. The resilience (repulsive force) can be adjusted by the metal material in use, the diameter of wires, the conditions for the rolling and the laying conditions. The diameter of the wire preferably used in the present invention is 0.1 to 0.3 mm, the coil diameter is 3 to 10 mm and the laying density is about 1 to 10 g/cm$^2$.

As shown in FIG. 2, the coil is disposed such that the coil axis is parallel to a rear wall of the cathode gas chamber in the present invention. The laying density of this coil "B" increases in the following ascending order, that is, "top part of cathode gas chamber"<"middle part of cathode gas chamber, "<"bottom part of cathode gas chamber", to generate the repulsive forces in this ascending order, thereby absorbing the differential pressures generated in the following ascending order, that is, "top part of cathode gas chamber"<"middle part of cathode gas chamber,"<"bottom part of cathode gas chamber". Accordingly, the excessive pressures applied on the ion exchange membrane and the anode are almost equalized.

The mat or the coil is laid in the cathode gas chamber of the electrolytic cell. The metallic cushion must exhibit the repulsive force to oppose the differential pressure between the anode chamber pressure and the cathode gas chamber pressure. In the practical electrolytic cell having a height of 1 to 1.3 m and anolyte density of about 1.1 g/cm$^3$, the liquid pressure of the anolyte at the deepest part is 11 to 13 kPa. The cushion material must be assembled under compression such that the repulsive force of 11 to 13 kPa or more is generated to oppose the liquid pressure. The larger repulsive force which presses the gas diffusion electrode at the pressure larger than the liquid pressure is useless and harmful because the larger repulsive force invites the damage of the ion exchange membrane and the deformation of the anode and further unnecessary material is employed. The excessive pressure obtained by deducting the liquid pressure from the repulsive force is preferably 10 kPa or less, and more preferably 1 to 7 kPa.

The uniform accommodation of the cushion material from the top part to the bottom part provides the pertinent pressure balance at the bottom part. However, since the liquid pressure is scarcely present at the top part, the repulsive force of the cushion material is excessive at the top part and the excessive pressure is supported by the anode. The ion exchange membrane sandwiched by the anode and the gas diffusion electrode is subject to the damage generated by the point-like or linearly concentrated compression.

Then, in view of the prevention of the ion exchange membrane damage, of the deformation of the anode and of the reduction of the expensive metal, the repulsive force of the cushion material is so reduced that the repulsive force at the top part of the cathode gas chamber is smallest in the present invention.

Then, the principle will be described referring to FIG. 3 which shows the compression characteristics of cushions "A" and "B" (the relation between thickness of the metallic cushion under compression and compression pressure). The cushion material "B" has a larger repulsive force. The compression of both of the cushion materials "A", "B" to the thickness (t) of the cathode gas chamber generates the compression pressures (repulsive forces) "L" and "M" in the respective cushion materials. When the cushion material "A" is accommodated at a point "L" (the above differential pressure can be approximated by "L" because the cathode gas chamber pressure is much smaller than the anode chamber pressure in the practical operation) under compression, the differential pressure and the repulsive force is counterbalanced. At the point shallower than the point having the pressure "L", the repulsive force is larger than the differential pressure so that the gas diffusion electrode is pressed on the ion exchange membrane at pertinent positive pressure. On the other hand, at the point deeper than the point having the pressure "L", the repulsive force is smaller than the differential pressure so that the gas diffusion electrode cannot be pressed on the ion exchange membrane. Accordingly, at the point deeper than the point of the pressure "L", the cushion material "B" having the larger repulsive force (its repulsive force is "M") is so used that the repulsive force becomes larger than the differential force, thereby pressing the gas diffusion electrode on the ion exchange membrane at pertinent positive pressure. Depending on the other conditions, it is preferable that the cushion "B" is accommodated in the lower part of the cathode gas chamber and the cushion "A" is accommodated in the upper part.

The repulsive force of the cushion material can be changed in the following manner.

The repulsive force of the mat can be changed by a wire diameter and the number of stacked sheets. The change of the wire diameter considerably changes the resilience. While, on the other hand, the considerable change of the resilience is hardly attained by the change of the number of the stacked sheets, the same material is advantageously used. The almost uniform pressures can be applied on the ion exchange membrane and the anode when the mat having the smaller number of the stacked sheets is accommodated at the top part of the cathode gas chamber and the mat having the larger number of the stacked sheets is accommodated at the bottom part under compression.

The repulsive force of the coil is similarly changed by the diameter of the thin wire, the coil diameter and the laying density. When the laying density of the coil is changed, the coil is overlapped as a pectinate shape so that the repulsive force is advantageously changed without the larger change of the thickness.

The ion exchange membrane electrolytic cell of the present invention can be obtained by accommodating the metallic cushion in the cathode gas chamber such that the repulsive force at the top part is smaller and the repulsive force at the bottom part is larger.

Effect of Invention

As described, the repulsive force (resilience) of the cushion material accommodated in the cathode gas chamber of the two-chamber electrolytic cell becomes smaller toward the top part in accordance with the differential pressure between the anode chamber pressure and the cathode gas chamber pressure, thereby preventing the application of the superfluous pressure on the ion exchange membrane, preventing the generation of scratches and providing the long-term stable operation. Further, the reduction of the amount of the cushion material, or of the precious materials such as silver and nickel can be attained.

BEST MODE FOR IMPLEMENTING INVENTION

Figure 1:
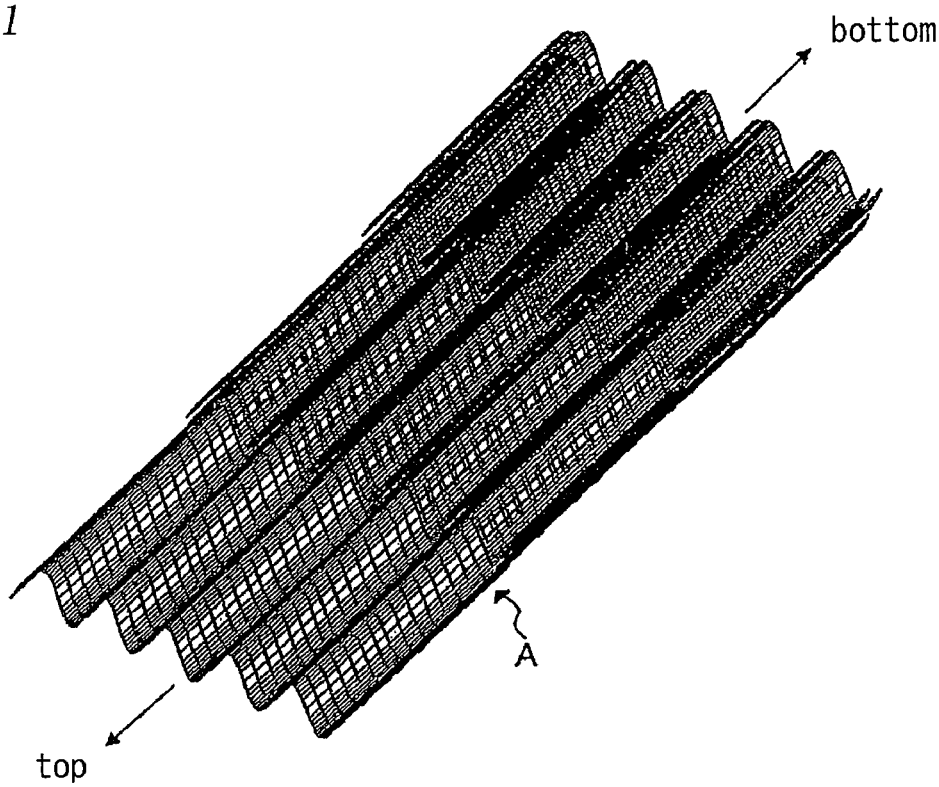
FIG. 1 is a perspective view exemplifying a mat.
Figure 2:
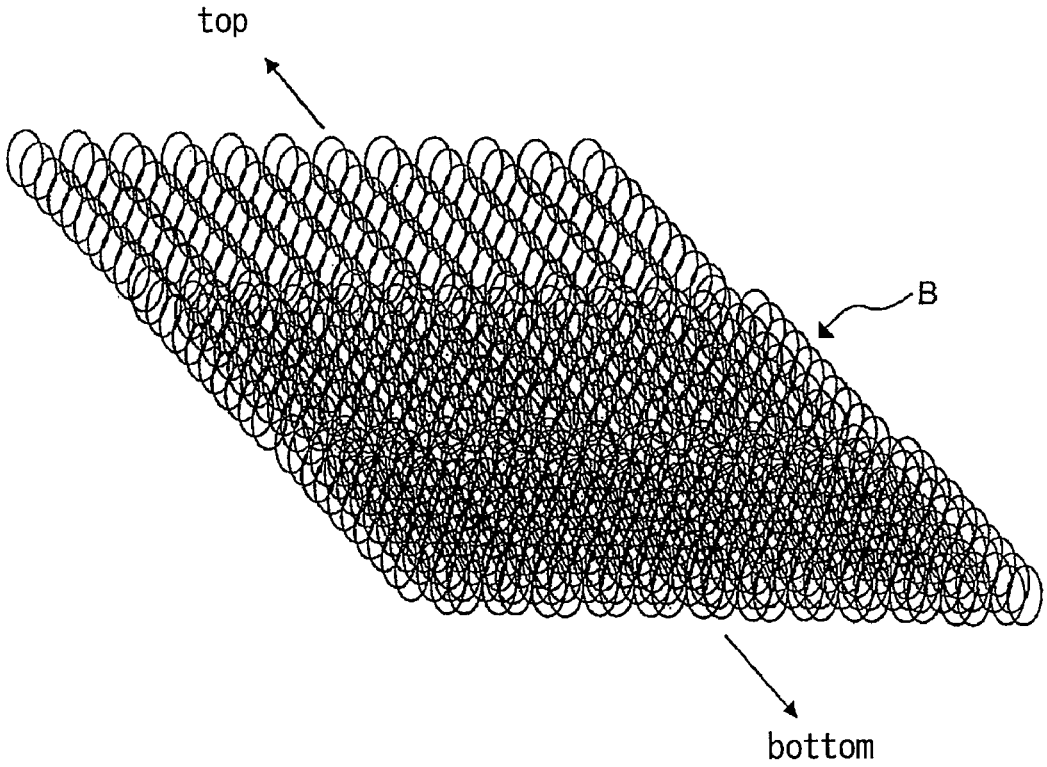
FIG. 2 is a perspective view exemplifying a coil.
Figure 3:
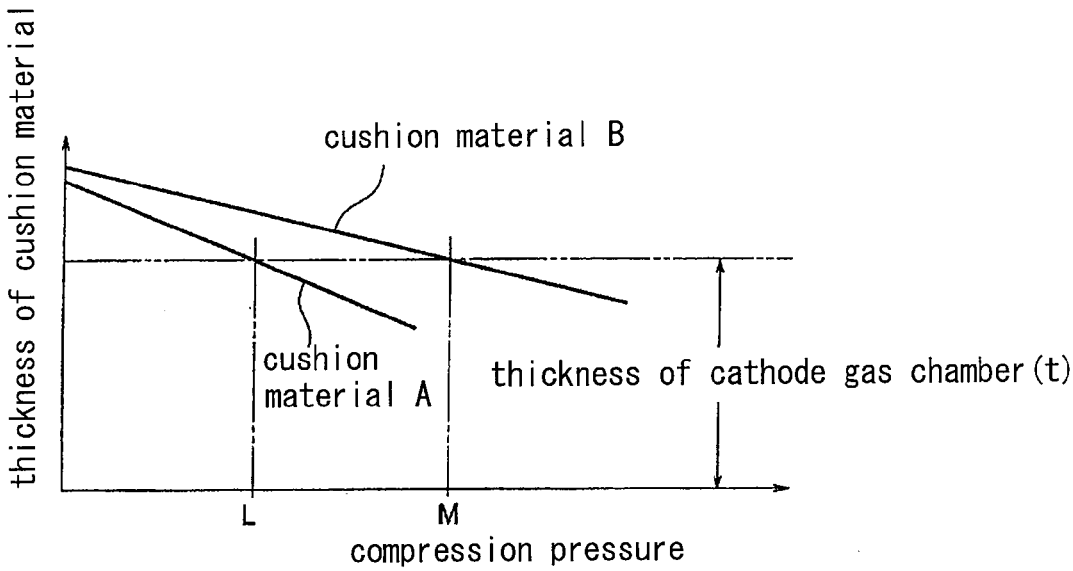
FIG. 3 is a graph exemplifying compression characteristics of cushion materials.

The respective elements of the electrolytic cell other than the metallic cushion will be described.

A sheet-shaped electrode is known as the gas diffusion electrode prepared by bonding carbon black, PTFE resin and catalyst, or PTFE resin and metal particles on a metal mesh and a carbon cloth acting as a substrate or a current collector. Thickness of the gas diffusion electrode is ordinarily 0.3 to 1 mm. While the electrode includes a liquid permeable one and a liquid non-permeable one, either of them is available in the two-chamber electrolytic cell.

The gas diffusion electrode includes a hydrophilic section through which sodium hydroxide permeates, a hydrophobic section through which oxygen is supplied, an electro-conductive section transmitting electrons and a reaction section. Hydrophilic carbon black and metal particles in the hydrophilic section, PTFE resin in the hydrophobic section, carbon black and metal particles in the electro-conductive section, and a catalyst in the reaction section take the respective roles.

While the catalyst includes silver, platinum, gold, metal oxides and carbon, the silver among them is a typical catalyst.

A perfluorocarbon cation exchange membrane having carboxylic acid, sulfonic acid and both acids as an ion exchange group currently available in the brine electrolysis using the ion exchange membrane electrolytic cell may be employed.

A liquid retention layer can be positioned between the ion exchange membrane and the gas diffusion electrode. The liquid retention layer fills the space to take an important role of uniformly retaining the sodium hydroxide solution. Without the liquid retention layer, no current can flow through the section having no liquid so that increases of current density and of voltage may take place. The close contact between the ion exchange membrane and the gas diffusion electrode enables the liquid retention because of a capillary phenomenon even without the liquid retention layer. However, in the actual meter-size electrolytic cell, the close contact between the entire surfaces is hardly practicable due to the limit of the electrode fabrication accuracy. Therefore, the securer retention of the liquid is preferable by sandwiching the liquid retention layer such as a soft cloth. The liquid retention layer also prevents the direct contact between the cathode-ion exchange membrane and the gas diffusion electrode. While the ion exchange membrane is swollen or elongated and contracted to create friction with the electrode when the liquid is initially introduced into the electrolytic cell or the liquid is removed at the rest, the soft liquid retention layer may act as a cushioning medium. The liquid retention layer is required to be hydrophilic because of the requisite of the liquid retention. Further, an excellent corrosion resistance is required because the sodium hydroxide solution of 30-something % and about 90 degree centigrade must be retained. A porous structure made of carbon or resin is a candidate for the liquid retention layer, and carbon fibers are the most excellent material. A cloth prepared by weaving fine fibers is also pertinent for retaining the liquid by using the capillary phenomenon.

A gas diffusion electrode support can be positioned between the cushion material and the gas diffusion electrode. A role of the gas diffusion electrode support is to receive the repulsive force of the metallic cushion and to deliver it to the gas diffusion electrode, the liquid retention layer and then to the ion exchange membrane. When the contact point density of the cushion material on the gas diffusion electrode side is high enough such that the distance between the adjacent contact points is only several millimeters, the gas diffusion electrode support is not necessarily required. However, the support is suitably mounted to deliver the uniform repulsive force of the cushion material to the gas diffusion electrode.

A mesh material made of metal can be used as the gas diffusion electrode support. The pore size thereof is desirably about 0.3 to 3 mm. The gas diffusion electrode is swollen at the pore of the gas diffusion electrode support toward the cathode gas chamber by the liquid pressure of anolyte. When the pore size exceeds 3 mm, the function as the support is lost. When the pore size is below 0.3 mm, the gas permeation is hindered.

The gas diffusion electrode support also acts as the current collector to be required to have excellent electro-conductivity, and is preferably a silver-plated metal material. Silver is desirably plated at contact points among the gas diffusion electrode, gas diffusion electrode support and a cathode gas chamber back wall When the gas diffusion electrode and the ion exchange membrane sandwiching the gas diffusion electrode support and the liquid retention layer are pressed to the ion exchange membrane, the five-layer stacking of the anode, the ion exchange membrane, the liquid retention layer, the gas diffusion electrode and the gas diffusion electrode support is obtained, desirably, in close contact among one another. The anode surface in contact with the ion exchange membrane is as smooth as possible so that the anode is a rigid body which is not deformed by the pressure from the cushion material.

The metal material for the gas diffusion electrode support is suitably Ni or high Ni alloy because the cathode gas chamber is a highly corrosive atmosphere having high temperature and high concentrations of oxygen and caustic soda. As described earlier, the high Ni alloy refers to alloy in which the Ni content is 20% in weight or more and less than 100% in weight, and includes inconel, hastelloy, monel and SUS310. Ni or the high Ni alloy is preferably plated with silver or gold for reducing the resistance at the contact surface with the gas diffusion electrode, thereby providing the stable structure having the low resistance for a longer period of time. While the Ni alloy has a slightly higher contact resistance on the surface and its electro-conductivity may be damaged due to the oxidative deterioration with time, the excellent electro-conductivity can be maintained by the plating of the silver. The plated thickness is preferably 1 μm or more.

Then, a two-chamber ion exchange membrane unit electrolytic cell in accordance with the present invention will be described referring to FIG. 4.

An electrolytic cell main body 1 is divided into an anode chamber 3 and a cathode gas chamber 4 by an ion exchange membrane 2. A mesh-like insoluble anode 5 is in close contact with the anode chamber 3 side of the ion exchange membrane 2, and a gas diffusion electrode 7 is in contact with the cathode gas chamber 4 side of the ion exchange membrane 2 through the intermediary of a liquid retention layer 6 made of carbon fiber fabric or organic polymer fibers. A gas diffusion electrode support 8 is positioned on the other side of the gas diffusion electrode 7. A cushion material 10 formed by a textile, a fabric or a coil made of metal wires is accommodated between the gas diffusion electrode support 8 and a cathode gas chamber back plate (cathode terminal) 9, that is, in the cathode gas chamber 4. As shown in FIG. 4, the cushion material 10 is accommodated such that the winding number is smaller in the top part of the cathode gas chamber and larger in the bottom part thereof.

A numeral 11 denotes an anolyte inlet mounted at the bottom part of the anode chamber, a numeral 12 denotes an anolyte and gas outlet mounted at the top part of the anode chamber, a numeral 13 denotes an oxygen containing gas inlet mounted at the top side surface of the cathode gas chamber, and a numeral 14 denotes an outlet for caustic soda aqueous solution and surplus oxygen gas mounted at the bottom part of the cathode gas chamber.

When electricity flows through both of the electrodes 5,7 with the brine supplied to the anode chamber 3 of the electrolytic cell main body 1 and with the oxygen containing gas supplied to the cathode gas chamber 4, water is supplied from the liquid retention layer 6 filled in the caustic soda aqueous solution and the oxygen containing gas is supplied from the opposite cathode gas chamber 4 side into the gas diffusion electrode 7 so that a caustic soda production reaction proceeds at the reaction point of the gas diffusion electrode. The high concentration caustic soda aqueous solution produced at the reaction point diffuses in accordance with the concentration gradient, flows down and is discharged through the outlet for caustic soda aqueous solution 14.

At this stage, the repulsive force of the cushion material 10 accommodated under compression presses the gas diffusion electrode support 8, the gas diffusion electrode 7 and the liquid retention layer 6 toward the ion exchange membrane 2 and the anode 5. In other words, the cathode gas chamber back plate 9—the cushion material 10—the gas diffusion electrode support 8—the gas diffusion electrode 7 are in close contact with one another by the repulsive force of the cushion material 10, thereby minimizing the contact resistance and reducing the voltage loss.

Further, the winding number of the cushion material decreases toward the top and increases toward the bottom, that is, the repulsive force decreases toward the top and increases toward the bottom so that the values of "(repulsive force)−(differential pressure)" at the top and bottom of the cathode gas chamber are nearly equalized. Thereby, the gas diffusion electrode 7 and the ion exchange membrane 2 can be maintained in close and uniform contact with each other on their whole surfaces, and the caustic soda aqueous solution acting as electrolyte can be held in the whole liquid retention layer 6 during the operation of the electrolytic cell. The anode and the ion exchange membrane 2 are in close contact with each other to minimize the electric resistance due to the anolyte. Since the repulsive force generated at the cushion material 10 in the cathode gas chamber is eventually supported by the anode 5 and the cathode gas chamber back plate 9, they must have rigidity to support the repulsive force, and flatness. When the flatness of the elements is lost to generate the unevenness of the repulsive force, the gas diffusion electrode 7 and the ion exchange membrane 2 are in non-uniform contact with each other. Accordingly, the caustic soda aqueous solution can be held at the point having the close contact to substantially increase the current density, thereby increasing the cell voltage. In addition, the current concentration may damage the ion exchange membrane 2, the anode 5 and the gas diffusion electrode 7.

EXAMPLES

Then, Examples of the ion exchange membrane electrolytic cell in accordance with the present invention will be described. However, the present invention shall not be deemed to be restricted thereto.

Example 1

Figure 4:
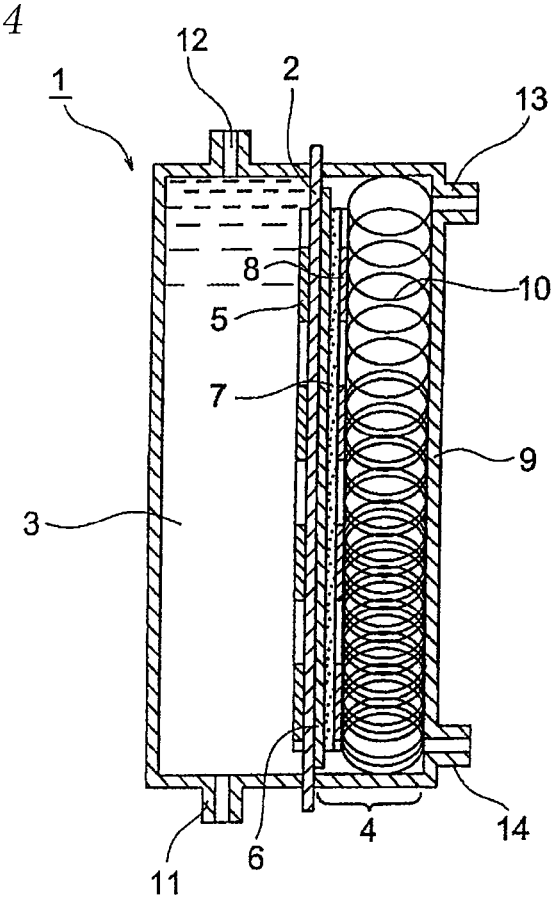
FIG. 4 is a schematic longitudinal sectional view exemplifying a two-chamber unit electrolytic cell.

A two-chamber ion exchange membrane electrolytic cell of which an effective surface area was a width of 100 mm and a height of 1200 mm was assembled as shown in FIG. 4.

An anode used was a dimensionally stable electrode available from Permelec Electrode, Ltd., and a cathode used was a liquid permeable gas diffusion electrode. The gas diffusion electrode was prepared by impregnating, with silver fine particles and PTFE fine particles, a substrate made of nickel foam electrically plated with silver, followed by hot-pressing. The respective reaction surface sizes were 100 mm in width and 1200 mm in height.

An ion exchange membrane used was Aciplex F4203 available from Asahi Kasei Chemicals Corporation, and a liquid retention layer used was a carbon cloth having thickness of 0.4 mm available from Zoltek Companies, Inc. which was then hydrophilically treated. A gas diffusion electrode support used was a plain-weaved nickel mesh of 24 mesh which was plated with silver.

A coil was used as a cushion material, which was prepared by rolling a nickel wire having a wire diameter of 0.17 mm and tensile strength from 620 to 680N/mm$^2$ (JIS H4554 (1999)) to provide a wire diameter of about 0.5 mm and a winding diameter of about 6 mm.

The coils were wound only in a longitudinal direction (two opposing sides of four sides) of rectangular frames (98 mm in width and 398 mm in height) made of a nickel round bar having a diameter of 1.6 mm to provide the cushion material. The coils were wound such that the laying density on the first frame was 6 g/dm$^2$, that on the second frame was 7 g/dm$^2$ and that on the third frame was 8 g/dm$^2$. Silver was plated on the three rectangular frames at 2, 2.3 and 2.65 g/dm$^2$ in the above order. A total amount of the silver used was 27.8 g. The repulsive forces were 6, 11 and 16 kPa in the above order when they were compressed to 6 mm. The three cushion materials (rectangular frames) each having the density of 6 g/dm$^2$, 7 g/dm$^2$ and 8 g/dm$^2$ were disposed at the top part, the central part and the bottom part, respectively, of the cathode gas chamber such that the coils extended in a vertical direction along the side edge of the gas diffusion electrode through the intermediary of the gas diffusion electrode support. The difference between the repulsive force and the liquid pressure at the respective depth direction was 1.6 kPa in minimum and 7.2 kPa in maximum. The cathode gas chamber back plate was made of nickel plated with silver having thickness of about 5 μm.

The above elements were stacked in the order of the cathode gas chamber back plate—the cushion material—the gas diffusion electrode support—the gas diffusion electrode—the ion exchange membrane—the anode, and an electrolytic cell was assembled by means of bolting such that thickness of the cathode gas chamber was 6 mm.

Brine heated to 87° C. having concentration of 305 g/liter was supplied to the anode chamber, and then 1.5 normal liter of oxygen concentrated by PSA (94% in volume) based on oxygen (1.2 times required theoretical amount) was supplied to the cathode gas chamber through the oxygen containing gas inlet. Electrolysis was conducted at current density of 3 kA/m$^2$ while the temperature of the entire electrolytic cell was adjusted to 87° C. After reaching of the steady state, the anolyte NaCl concentration was 155 g/liter, and the produced caustic soda concentration was 32.4%. The voltage stably remained at 1.95 V for more than two months. The current efficiency at this stage was 96%. After two months, the electrolytic cell was disassembled. The ion exchange membrane was observed to generate no abnormality.

Comparative Example 1

The electrolytic cell was assembled and operated in the same manner as Example 1 except that the laying densities of all of the three cushion materials were 8 g/dm$^2$. The difference between the repulsive force and the liquid pressure at the respective depth direction was 2.8 kPa in minimum and 16 kPa in maximum. A total amount of the silver used was 31.8 g. While the voltage and the current efficiency were initially 1.95 V and 96%, respectively, they were 2.01 V and 95% after two months. The electrolytic cell was disassembled, and the ion exchange membrane was observed to include several scratches at its top generated probably by the sandwiching between the electrodes

Example 2

A similar test was conducted to Example 1 except that a demister mesh was employed as the cushion material.

The demister meshes were prepared by knitting nickel wires having wire diameter of 0.25 mm and a pitch of 5 mm in stockinet and processing the meshes to wavy shape having depth of 5 mm and a pitch of 10 mm followed by the electric plating of silver. An amount of the plated silver was 0.5 g/mesh.dm$^2$. When four sheets, five sheets and six sheets of the above meshes were stacked and compressed to 5.5 mm, the repulsive forces of the stacks were 7, 11 and 15 kPa, respectively. The four demister meshes were disposed on the top one-third of the cathode gas chamber, the five demister meshes were disposed on the central one-third of the cathode gas chamber, and the six demister meshes were disposed on the bottom one-third of the cathode gas chamber. The difference between the repulsive force and the liquid pressure at the respective depth direction was 2.6 kPa in minimum and 6.2 kPa in maximum. An amount of the plated silver was 30 g in total.

After an electrolytic cell was assembled such that cathode gas chamber thickness was 5.5 mm, electrolysis was conducted similar to Example 1. Voltage at current density of 3 kA/m$^2$ was 1.93 V, and current efficiency was 96%, and these values were stably maintained for two months. The electrolytic cell was disassembled, and the ion exchange membrane was observed to generate no abnormality.

Comparative Example 2

The electrolytic cell was assembled and operated in the same manner as Example 1 except that the laying densities of all of the three cushion materials were 8 g/dm2. The difference between the repulsive force and the liquid pressure at the respective depth direction was 2.8 kPa in minimum and 16 kPa in maximum. A total amount of the silver used was 31.8 g. While the voltage and the current efficiency were initially 1.95 V and 96%, respectively, they were 2.01 V and 95% after two months. The electrolytic cell was disassembled, and the ion exchange membrane was observed to include several scratches at its top generated probably by the sandwiching between the electrodes.

Since the above embodiments are described only for examples, the present invention is not limited to the above embodiments, and various modifications or alterations can be easily made therefrom by those skilled in the art without departing from the scope of the present invention.

The invention claimed is:

1. An ion exchange membrane electrolytic cell comprising an anode chamber accommodating an anode and a cathode gas chamber accommodating a gas diffusion electrode, the anode and the cathode gas chamber being divided by an ion exchange membrane wherein a metallic cushion is accommodated under compression between a back plate of the cathode gas chamber and the gas diffusion electrode such that a repulsive force of the metallic cushion at a bottom part of the cathode gas chamber is larger than that at a top part of the cathode gas chamber; and wherein the repulsive force at respective points in a longitudinal direction of the metallic cushion is larger than the pressure difference between the anode chamber liquid pressure and the cathode gas chamber pressure, and the excess of the repulsive force over the pressure difference, during operation of the electrolytic cell, is a minimum of 1 kPa and a maximum of 7.2 kPa.

2. The electrolytic cell as claimed in claim 1, wherein the metallic cushion is in a form of a coil.

3. The electrolytic cell as claimed in claim 2, wherein installation density of the coiled metallic cushion accommodated under compression in an upper part of the cathode gas chamber is smaller than the installation density of the coiled metallic cushion accommodated under compression in a lower part of the cathode gas chamber.

4. The electrolytic cell as claimed in claim 2, wherein a diameter of the coiled metallic cushion accommodated under compression in an upper part of the cathode gas chamber is smaller than the diameter of the coiled metallic cushion accommodated under compression in a lower part of the cathode gas chamber.

5. The electrolytic cell as claimed in claim 1, wherein the metallic cushion is a wavy mat.

6. The electrolytic cell as claimed in claim 5, wherein the number of stacked metallic cushion mats accommodated under compression in an upper part of the cathode gas chamber is smaller than the number of stacked metallic cushion mats accommodated under compression in a lower part of the cathode gas chamber.

7. The electrolytic cell as claimed in claim 5, wherein a diameter of the metallic cushion mat accommodated under compression in an upper part of the cathode gas chamber is smaller than the diameter of the coiled metallic cushion mat accommodated under compression in a lower part of the cathode gas chamber.

8. The electrolytic cell as claimed in claim 1, wherein the metallic cushion is made of Ni or high Ni alloy.

9. The electrolytic cell as claimed in claim 1, wherein a maximum of the excess of the repulsive force over the pressure difference is 7 kPa.

10. The electrolytic cell as claimed in claim 1, wherein a minimum of the excess of the repulsive force over the pressure difference is 1.6 kPa.

11. A method of producing caustic soda comprising a step of introducing into the electrolytic cell claimed in claim 1 reagents to produce caustic soda.

12. A method of producing chlorine comprising a step of introducing into the electrolytic cell claimed in claim 1 reagents to produce chlorine.

13. A method of producing caustic soda and chlorine comprising a step of introducing into the electrolytic cell claimed in claim 1 reagents to produce caustic soda and chlorine.

* * * * *

UNITED STATES PATENT AND TRADEMARK OFFICE

CERTIFICATE OF CORRECTION

PATENT NO. : 8,197,649 B2
APPLICATION NO. : 11/914668
DATED : June 12, 2012
INVENTOR(S) : Koji Saiki et al.

It is certified that error appears in the above-identified patent and that said Letters Patent is hereby corrected as shown below:

Title Page, Item (86) the date should be November 16, 2007

Signed and Sealed this
Twenty-seventh Day of November, 2012

David J. Kappos

David J. Kappos
*Director of the United States Patent and Trademark Office*